US008939137B2

(12) United States Patent
Hunt

(10) Patent No.: US 8,939,137 B2
(45) Date of Patent: Jan. 27, 2015

(54) GATED FULL CAPTURE ARCHERY REST

(71) Applicant: Field Logic, Inc., Superior, WI (US)

(72) Inventor: Fred Hunt, Duluth, MN (US)

(73) Assignee: Field Logic, Inc., Superior, WI (US)

( * ) Notice: Subject to any disclaimer, the term of this patent is extended or adjusted under 35 U.S.C. 154(b) by 45 days.

(21) Appl. No.: 13/864,958

(22) Filed: Apr. 17, 2013

(65) Prior Publication Data

US 2014/0014082 A1 Jan. 16, 2014

Related U.S. Application Data

(60) Provisional application No. 61/625,564, filed on Apr. 17, 2012.

(51) Int. Cl.
*F41B 5/22* (2006.01)
*F41B 5/14* (2006.01)

(52) U.S. Cl.
CPC ..... *F41B 5/143* (2013.01)
USPC ..... 124/44.5

(58) Field of Classification Search
CPC ..... F41B 5/143
USPC ..... 124/24.1, 44.5
See application file for complete search history.

(56) References Cited

U.S. PATENT DOCUMENTS

| | | | | | |
|---|---|---|---|---|---|
| 4,351,311 | A * | 9/1982 | Phares | ..... | 124/44.5 |
| 5,042,450 | A * | 8/1991 | Jacobson | ..... | 124/44.5 |
| 5,253,633 | A * | 10/1993 | Sisko | ..... | 124/44.5 |
| 5,460,153 | A * | 10/1995 | Huntt | ..... | 124/44.5 |
| 5,526,800 | A * | 6/1996 | Christian | ..... | 124/44.5 |
| 6,561,175 | B1 * | 5/2003 | Tidmore | ..... | 124/44.5 |
| 6,772,747 | B1 * | 8/2004 | Vastag | ..... | 124/44.5 |
| 6,978,775 | B2 * | 12/2005 | Graf | ..... | 124/44.5 |
| 7,975,680 | B1 * | 7/2011 | Montgomery | ..... | 124/44.5 |

* cited by examiner

*Primary Examiner* — John Ricci
(74) *Attorney, Agent, or Firm* — Stoel Rives LLP

(57) ABSTRACT

An arrow rest for retaining an arrow in a shooting position on an archery bow. The arrow rest includes a generally ring shaped structure surrounding a center opening. The ring structure includes a gap configured to receive the arrow in the center opening. A gate is pivotally attached to the ring structure and biased to extend across the gap in a closed position. At least one fixed arrow support is attached to the ring and extends into the center opening toward the shooting position. At least two pivoting arrow supports are pivotally attached to the ring and biased toward the shooting position of the center opening. The pivoting arrow supports are biased to capture the arrow against the fixed arrow support in the shooting position of the center opening and to rotate away from the shooting position when the arrow is launched from the archery bow.

14 Claims, 3 Drawing Sheets

GATED FULL CAPTURE ARCHERY REST

RELATED APPLICATIONS

The present application claims the benefit of U.S. Provisional application Ser. No. 61/625,564, entitled Gated Full Capture Archery Rest, filed Apr. 17, 2012, which is hereby incorporated by reference.

FIELD OF THE INVENTION

The disclosure generally relates to archery equipment and more particularly to a gated arrow rest.

BACKGROUND

Arrow rests are well known in the art. An arrow rest provides support to the arrow while the bow is being carried, drawn, released, and during the initial flight of an arrow until it departs the bow. In order for a rest to be effective the rest must offer enough support to the arrow to enable the bow to be carried and drawn safely without the arrow falling from the rest. The rest must impart minimal friction to the arrow to prevent parasitic kinetic energy losses. An arrow rest must be durable enough to withstand thousands of shots and rough handling without changing the point of impact. Ideally, the rest should have minimal contact with the fletching (feathers) on the arrow. Fletchings are an integral part of accurate arrow flight, and any contact to the fletchings can disrupt the arrow's flight, and rest induced damage to the fletchings can degrade the accuracy of the affected arrow.

U.S. Pat. 5,070,855 (Troncoso) discloses an archery rest that consists of two prongs that form a "U" shaped trough that is biased against the arrow by a spring. The arrow rests on the points of the two prongs. Troncoso provides an arrow rest that is sufficiently rigid and durable, imparts little friction to the arrow, and has minimal fletching contact, but does very little to prevent the arrow from falling off of the rest. With this style rest it is difficult for archers, especially beginners, to draw the bow without the arrow falling off of the rest.

U.S. Pat. No. 6,978,775 (Graf) discloses an arrow rest that consists of a plurality of radially disposed, inwardly projecting brush bristles. This style rest provides very good containment, but has a large amount of frictional losses and fletching contact. Additionally, the brush material is consumed during the shooting process, requiring frequent replacement of the brush material.

U.S. Pat. No. 6,994,080 (Yoder) discloses a similar variant of arrow rest to the Graf patent with the exception of rather than having a semi-continuous ring of inwardly projected, radially disposed bristles, there are three spaced apart arrow supports mounted to a ring at 120 degree intervals. These supports consist of a support shoe and a plurality of bristles that extend inwardly from the support shoe for supporting the arrow. The support shoe and brush bristles are located at 2:00, 6:00, and 10:00 o'clock as the rest mounted on the bow with the arrow located in the center of the ring. The arrow is loaded into the rest by placing the arrow in the slot in the ring between approximately 11:00 and 1:00 o'clock and pushing the arrow down between the 2:00 and 10:00 o'clock brushes. This style rest decreases the frictional losses and fletching wear associated with the Graf patent, but still suffers from significant brush wear and difficulty loading of the arrow into the rest. Additionally, it is possible for the arrow to fall down between the lower brushes, or be expelled upward between the two upper brushes, completely out of the arrow rest.

SUMMARY OF THE INVENTION

The present disclosure is directed to an arrow rest for retaining an arrow in a shooting position on an archery bow. The arrow rest includes a generally ring shaped structure surrounding a center opening. The ring structure includes a gap configured to receive the arrow in the center opening. A gate is pivotally attached to the ring structure and biased to extend across the gap in a closed position. At least one fixed arrow support is attached to the ring and extends into the center opening toward the shooting position. At least two pivoting arrow supports are pivotally attached to the ring and biased toward the shooting position of the center opening. The pivoting arrow supports are biased to capture the arrow against the fixed arrow support in the shooting position of the center opening and to rotate away from the shooting position when the arrow is launched from the archery bow.

The present disclosure is directed to a system and methods for providing a segmented ring shaped arrow rest that has three points of contact supporting the arrow. The contacts are located at approximately 0 degrees, 120 degrees, 240 degrees. The lower two supports are independently spring loaded launchers, preferably composed of a low friction thermoplastic. The upper support can be either another spring loaded device similar to the lower supports or a flexible brush. The three supports come together in the middle of the ring to form three points of contact with the arrow. The supports are disposed such that there is minimal fletching contact on the arrow on a standard three fletching arrow. A gap in the segmented ring is located between approximately 270 degrees and 315 degrees for a right handed shooter (45 degrees to 90 degrees for a left-handed shooter) for loading the arrow.

The two lower supports are spring loaded launchers mounted on threaded pins that are parallel with the loaded arrow. The launchers are biased upwards toward the arrow with torsion springs. During loading or on the shot, the torsion springs can be overpowered such that the launcher is allowed to rotate about the threaded pin, downward towards the bottom of the ring approximately 15 degrees.

In another exemplary embodiment, the gap in the segmented ring structure is closed with a spring loaded gate. The ring is adapted to accept the gate such that it hinges either at the top or the bottom of the gap in the ring.

In another exemplary embodiment, the gate is disposed such that when the gate is pushed open with the arrow, the gate displaces the spring loaded launcher and allows the arrow to be loaded into position with diminished interference.

An advantage of the present disclosure is that it allows for diminished frictional losses imparted to the arrow due to the low friction, spring loaded launchers.

Another advantage of the present disclosure is that it offers improved accuracy due to the lack of fletching contact with the brushes.

Yet another advantage of the present disclosure is that it reduces the wear associated with brushes supporting the bottom of an arrow during the shot. This reduces the inaccuracies associated with the degradation of the brush material.

Yet another advantage of the present disclosure is that the gate prevents the arrow from leaving the rest should the arrow be bumped while an arrow is loaded.

Yet another advantage of the current disclosure is that the gate assists in the loading if the arrow by displacing the lower launcher. This feature reduces the effort required to load the arrow and reduces the noise resulting from loading the arrow. The gate assisted loading also allows for the launchers to be disposed in a much tighter arrangement, greatly reducing the chance for the arrow to fall off of the launchers while the bow is being drawn and shot.

These exemplary embodiments are mentioned not to summarize the disclosure, but to provide an example of an embodiment to aid in the understanding. Exemplary embodiments will be discussed in the Detailed Description, and further description of the disclosure will be provided there. Further advantages will be understood by examining these specifications.

BRIEF DESCRIPTION OF THE DRAWINGS

The accompanying drawing, which constitutes part of the specification, helps to illustrate embodiments of the disclosure.

DESCRIPTION OF THE PREFERRED EMBODIMENT

Figure 1:
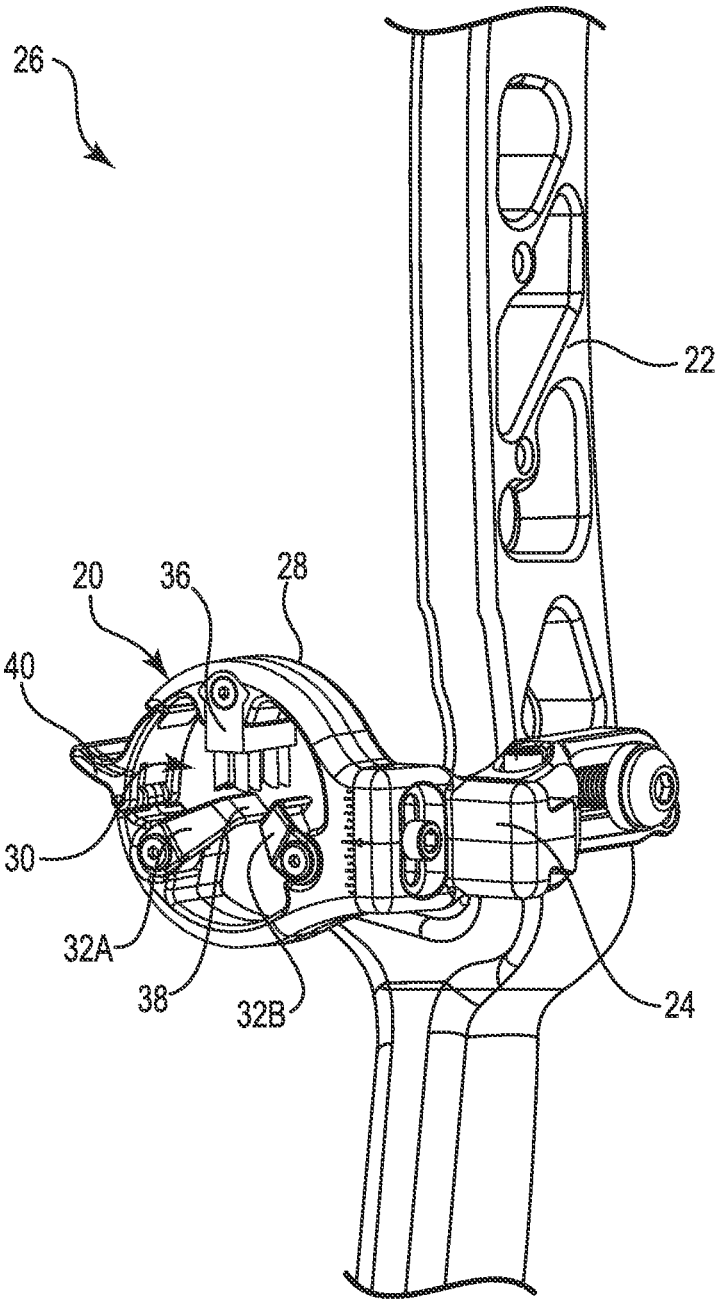
FIG. 1 is an isometric view of the arrow rest assembly according to an embodiment of the disclosure.

FIG. 1 is a perspective view of arrow rest 20 mounted to bow 26 in accordance with an embodiment of the present disclosure. Mounting bracket 24 attaches the arrow rest 20 to the riser 22. A variety of mounting brackets are known for this purpose.

Figure 5:
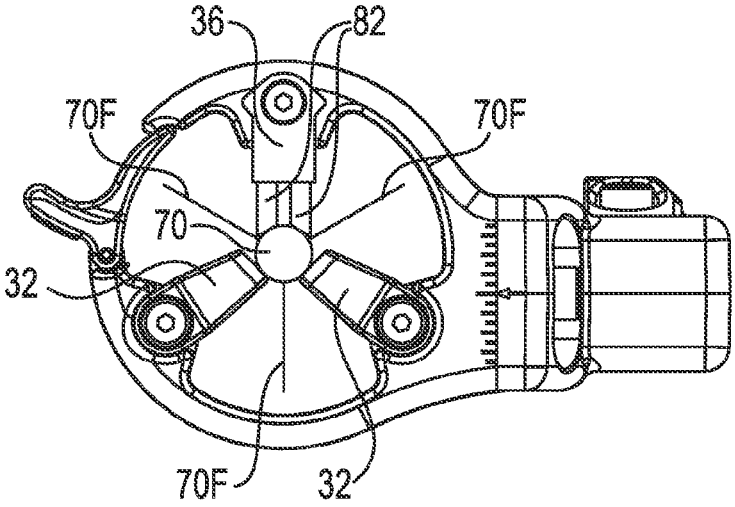
FIG. 5 illustrates the arrow of FIG. 4 in a shooting position.

The arrow rest 20 includes a segmented ring 28 with center opening 30 configured to receive an arrow (see e.g., FIG. 5). Pivoting gate 40 forms part of the segmented ring 28.

Within the center opening 30 is a pair of pivoting lower supports 32A, 32B ("32"), preferably located at 120 degrees and 240 degrees relative to the ring 28. In the illustrated embodiment, the lower supports 32 pivot around axes 34A, 34B ("34") and are biased upward to engage the arrow (see e.g., FIG. 5).

Upper support 36 can be either another pivoting spring loaded device similar to the lower supports 32 or a flexible structure, such as a brush. The three supports 32, 36 come together in the center 38 of the ring 28 to form three points of contact with an arrow. The center 38 is also referred to as the shooting position.

Figure 2:
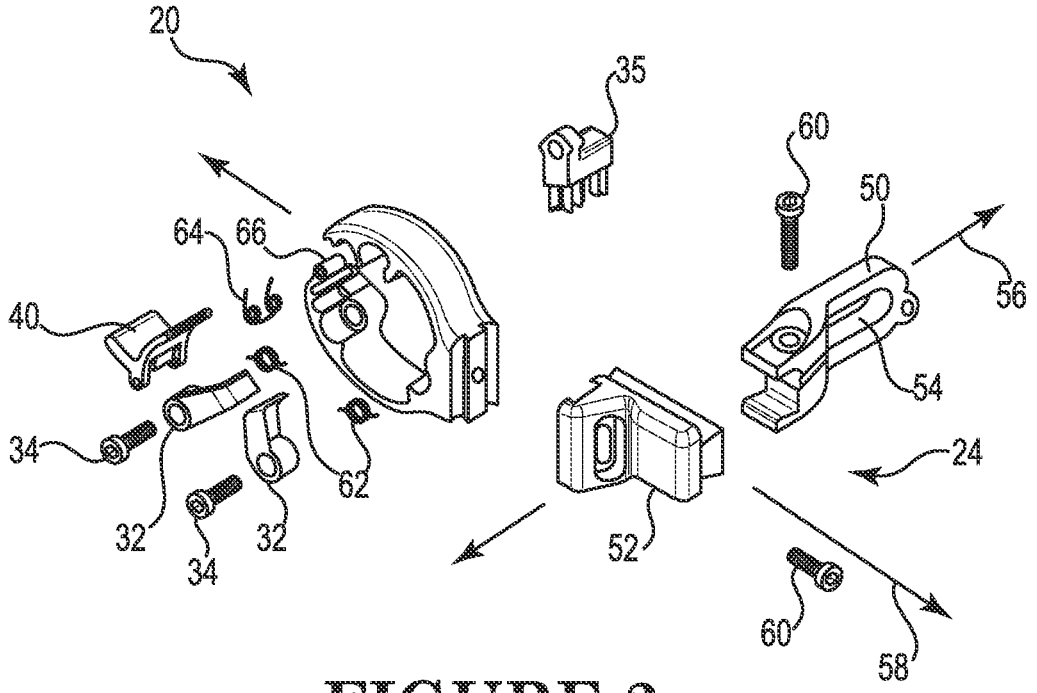
FIG. 2 is an exploded view of the arrow rest of FIG. 1.

FIG. 2 is an exploded view of the arrow rest 20 of FIG. 1. The mounting bracket 24 includes first portion 50 that mounts to the riser 22 and second portion 52 that mounts to the ring 28. The first portion 50 includes elongated mounting slot 54 that permits the position of the ring 28 to be adjusted relative to the riser 22 along the z-axis 56. The second portion 52 slides relative to the first portion 50 along the x-axis 58 relative to the riser 22. Fasteners 60 secure the ring 28 in the desired location relative to the riser 22.

The lower supports 32 are pivotally attached to the ring 28 by pivot pins 34. Springs 62 bias the lower supports 32 into engagement with the arrow (see FIG. 5). Spring 64 biases the gate 40 to the closed position (see FIG. 3). The gate 40 is sized to extend across gap 66 in the ring 28. The gap 66 is typically located between about 270-315 degrees on the ring 28 for right handed shooters and 45-90 degrees for left-handed shooters.

Figure 3:
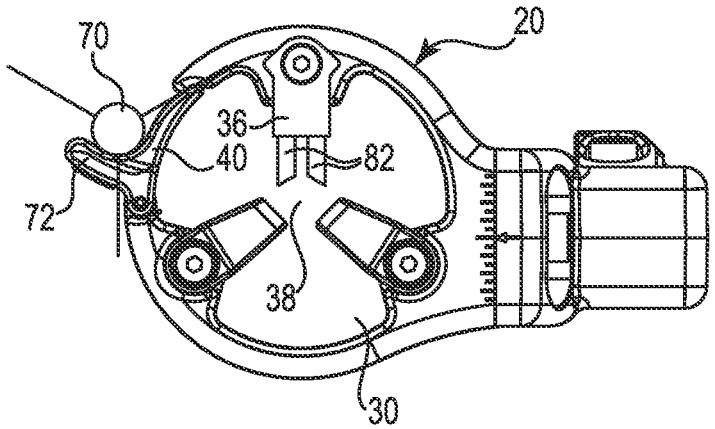
FIG. 3 is an end on view of the arrow rest of FIG. 1 with the arrow ready to be loaded into the rest by the user.
Figure 4:
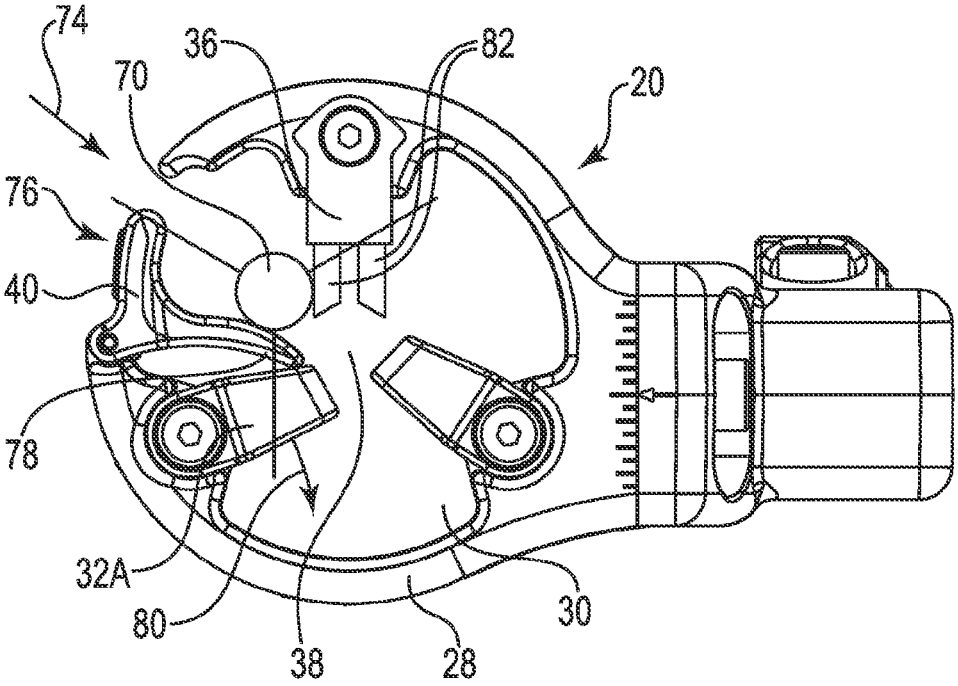
FIG. 4 illustrates the gate and one launcher of FIG. 1 being displaced during loading of an arrow.

FIGS. 3 through 5 illustrate the process of loading arrow 70 in the arrow rest 20 in accordance with an embodiment of the present disclosure. The shaft of the arrow 70 is press against the gate 40. Flange 72 on the gate 40 positions the arrow 70 in the optimum position.

Force 74 overcomes the biasing force of the gate spring 64 and pushes the gate 40 to the open position 76 illustrated in FIG. 4. Distal end 78 of the gate 40 rotates the lower support 32A in direction 80 toward the lower portion of the ring 28. In an embodiment in which the upper support 36 is rigid, the lower support 32A will continue to rotate in the direction 80 until the arrow 70 can be positioned in the center 38 of the opening 30. In an embodiment in which the upper support 36 includes flexible brushes 82, the brushes 82 are deformed to permit the arrow 70 to be positioned in the center 38.

FIG. 5 illustrates the arrow 70 in the shooting position 38 of the center opening 30. The lower support 32A has rotated into engagement with the arrow 70 and the gate 40 is in a closed position 84. In the illustrated embodiment, the upper support 36 contacts the arrow 70 in two locations.

The supports 32, 36 are located at 120, 240 and 0 degrees, while the arrow fletching 70A is located at 45, 180 and 315 degrees, so there is minimal contact with the supports 32, 36. As noted above, the supports 32 are biased by springs 62 toward the center 38 to retain the arrow 70 in the shooting position 38. When the arrow 70 is launched, the torsion springs 62 are overpowered such that the supports 32 rotate in direction 80 about 15 degrees toward the ring 28, and out of engagement with the arrow 70.

Where a range of values is provided, it is understood that each intervening value, to the tenth of the unit of the lower limit unless the context clearly dictates otherwise, between the upper and lower limit of that range and any other stated or intervening value in that stated range is encompassed within the embodiments of the disclosure. The upper and lower limits of these smaller ranges which may independently be included in the smaller ranges is also encompassed within the embodiments of the disclosure, subject to any specifically excluded limit in the stated range. Where the stated range includes one or both of the limits, ranges excluding either both of those included limits are also included in the embodiments of the present disclosure.

Unless defined otherwise, all technical and scientific terms used herein have the same meaning as commonly understood by one of ordinary skill in the art to which the embodiments of the present disclosure belong. Although any methods and materials similar or equivalent to those described herein can also be used in the practice or testing of the embodiments of the present disclosure, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present disclosure is not entitled to antedate such publication by virtue of prior invention. Further, the dates of publication provided may be different from the actual publication dates which may need to be independently confirmed.

Other embodiments of the disclosure are possible. Although the description above contains much specificity, these should not be construed as limiting the scope of the disclosure, but as merely providing illustrations of some of the presently preferred embodiments of this disclosure. It is also contemplated that various combinations or sub-combinations of the specific features and aspects of the embodiments may be made and still fall within the scope of the present disclosure. It should be understood that various features and aspects of the disclosed embodiments can be combined with or substituted for one another in order to form varying modes of the disclosed embodiments of the disclosure. Thus, it is intended that the scope of the present disclosure herein disclosed should not be limited by the particular disclosed embodiments described above.

Thus the scope of this disclosure should be determined by the appended claims and their legal equivalents. Therefore, it will be appreciated that the scope of the present disclosure fully encompasses other embodiments which may become obvious to those skilled in the art, and that the scope of the present disclosure is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment(s) that are known to those of ordinary skill in the art are expressly incorporated herein by reference and are intended to be encompassed by the present claims. Moreover, it is not necessary for a device or method to address each and every problem sought to be solved by the present disclosure, for it to be encompassed by the present claims. Furthermore, no element, component, or method step in the present disclosure is intended to be dedicated to the public regardless of whether the element, component, or method step is explicitly recited in the claims.

What is claimed:

1. An arrow rest for retaining an arrow in a shooting position on an archery bow, the arrow rest comprising:

a generally ring shaped structure surrounding a center opening, the ring structure including a gap configured to receive the arrow in the center opening;

a gate pivotally attached to the ring structure and biased to extend across the gap in a closed position;

at least one fixed arrow support attached to the ring and extending into the center opening toward the shooting position; and at least two pivoting arrow supports pivotally attached to the ring and biased toward the shooting position of the center opening, wherein the pivoting arrow supports are biased to capture the arrow against the fixed arrow support in the shooting position of the center opening and to rotate away from the shooting position when the arrow is launched from the archery bow;

wherein the gate displaces at least one of the pivoting arrow supports when in an open position to facilitate positioning the arrow in the shooting position.

2. The arrow rest of claim 1 wherein the gate displaces an adjacent pivoting arrow support when in an open position to facilitate positioning the arrow in the shooting position.

3. The arrow rest of claim 1 wherein the gate is in the closed position when the arrow is in the shooting position.

4. The arrow rest of claim 1 wherein the pivoting arrow supports are located at 120 degrees and 240 degrees relative to the ring shaped structure.

5. The arrow rest of claim 1 wherein the fixed arrow support includes one of a rigid structure or a flexible structure that engages with the arrow in the shooting position.

6. The arrow rest of claim 1 wherein the pivoting arrow supports include a low friction surface that engages with the arrow in the shooting position.

7. The arrow rest of claim 1 comprising a mounting bracket configured to attached the arrow rest to the archery bow.

8. The arrow rest of claim 7 wherein the mounting bracket is configured to adjust the location of the ring structure relative to the archery bow in at least two degrees of freedom.

9. A method of retaining an arrow in a shooting position on an archery bow comprising the steps of:

displacing a gate on a generally ring shaped structure to advance an arrow through a gap into a center opening of an arrow rest;

engaging the gate with at least one of pivoting arrow support located in the center opening of the ring shaped structure when the gate is in an open position to displace the at least one pivoting arrow support;

positioning the arrow in the shooting position;

biasing the at least one pivoting arrow support to capture the arrow against at least one fixed arrow support to secure the arrow in the shooting position; and biasing the gate to a closed position extending across the gap.

10. The method of claim 9 comprising rotating the pivoting arrow supports away from the shooting position when the arrow is launched from the bow.

11. The method of claim 9 wherein the gate is in the closed position when the arrow is in the shooting position.

12. The method of claim 9 wherein the pivoting arrow supports are located at 120 degrees and 240 degrees relative to the ring shaped structure.

13. The method of claim 9 wherein the fixed arrow support includes on of a rigid structure or a flexible structure that engages with the arrow in the shooting position.

14. An arrow rest that retains an arrow in a shooting position on an archery bow, the arrow rest comprising:

a generally ring shaped structure surrounding a center opening, the ring structure including a gap configured to receive the arrow in the center opening;

at least one arrow support attached to the ring and extending into the center opening toward the shooting position;

at least one pivoting arrow support pivotally attached to the ring and biased toward the shooting position of the center opening to capture the arrow against the at least one arrow support, the pivoting arrow support rotating away from the shooting position when the arrow is launched from the archery bow; and a gate pivotally attached to the ring structure and biased to extend across the gap in a closed position, wherein the gate displaces the at least one pivoting arrow supports when in an open position to facilitate positioning the arrow in the shooting position.

* * * * *